United States Patent [19]

Dieleman et al.

[11] 4,086,512

[45] Apr. 25, 1978

[54] CAMERA TUBE EMPLOYING SILICON-CHALCOGENIDE TARGET WITH HETEROJUNCTION

[75] Inventors: Jan Dieleman; Arthur Marie Eugene Hoeberechts, both of Eindhoven, Netherlands

[73] Assignee: U.S. Philips Corporation, New York, N.Y.

[21] Appl. No.: 667,908

[22] Filed: Mar. 17, 1976

Related U.S. Application Data

[63] Continuation of Ser. No. 515,454, Oct. 17, 1974, abandoned.

[30] Foreign Application Priority Data

Oct. 27, 1973 Netherlands ..... 7314803

[51] Int. Cl.[2] ..... H01J 29/45; H01J 31/38

[52] U.S. Cl. ..... 313/366; 313/386

[58] Field of Search ..... 313/386, 366, 367; 357/31

[56] References Cited

U.S. PATENT DOCUMENTS

| | | | |
|---|---|---|---|
| B 515,455 | 1/1976 | Dieleman et al. | 313/366 |
| 3,350,595 | 10/1967 | Kramer | 313/386 |
| 3,794,835 | 2/1974 | Hirai et al. | 357/31 |

FOREIGN PATENT DOCUMENTS

| | | | |
|---|---|---|---|
| 2,132,287 | 1/1972 | Germany | 313/366 |

*Primary Examiner*—Robert Segal

*Attorney, Agent, or Firm*—Frank R. Trifari; Carl P. Steinhauser

[57] ABSTRACT

A camera tube target formed by a radiation-receiving silicon layer which on a side to be scanned by the electron beam has a chalcogen-containing layer having intrinsic conductivity which forms a hetero junction with the silicon layer, the chalcogen-containing layer comprising at least one element of the fourth group of the periodic table of elements in an atomic ratio to the chalcogen component lying between 1:1 and 1:2.

4 Claims, 2 Drawing Figures

CAMERA TUBE EMPLOYING SILICON CHALCOGENIDE TARGET WITH HETEROJUNCTION

This is a continuation, of application Ser. No. 515,454, filed Oct. 17, 1974 now abandoned.

The invention relates to a camera tube having an electron source and a target to be scanned by an electron beam emerging from said source, said target being formed by a silicon layer which receives radiation and which on its side to be scanned by the electron beam has a chalcogen-containing layer which forms a hetero junction with the silicon layer. Radiation is to be understood to mean herein electro-magnetic radiation both in the visible and in the short wave and long wave part of the spectrum, as well as corpuscular radiation to which the silicon is sensitive. The chalcogens include sulphur, selenium and tellurium. A hetero junction is a junction between two layers of materials having different chemical compositions, not counting possibly present doping materials.

Camera tubes of the aforesaid types have already been described in literature several times. Other known camera tubes have, for example, targets which have a mosaic of diodes on the side to be scanned by the electron beam, the diodes being separated by material which is covered with an insulating layer. Targets having mosaics of diodes often show the drawback of burning-in by X-rays generated in the camera tube and of so-called "MOS-blooming" in which due to channel formation below the oxide layer, in particular with comparatively large radiation intensity, generated charge carriers flow to adjacent diodes so that the picture disappears.

In targets having in principle one hetero junction the said problems of targets having mosaics of diodes are not expected and it is furthermore to be expected that they can be manufactured more easily than the last-mentioned targets. It is also known, however, that the quality of the hetero junctions is often poor and only few of the expected advantages have been realised as a result of a poor matching of the properties of the two layers which form the hetero junction. This may result in too high a transverse conductivity and in increased recombination of charge carriers generated by radiation so that the resolving power and the sensitivity relative to targets having a multiple of laterally insulated diodes decrease considerably.

It may be tried, for example, to reduce the transverse conductivity (see, for example, the article by Yamato c.s. in I.E.E.E. Trans. Electr. Devices, 19, pp. 385–386 (No. 3, March, 1972)) by providing a silicon body with an insulating oxide layer in which on the oxide layer and in apertures therein a cadmium telluride layer is provided on the silicon. A camera tube having such a target requires more process steps in the manufacture as compared with that having a continuous hetero junction, is comparatively slow and, like other known targets having hetero junctions, is not very sensitive. Also, for example, a target known from Dutch Pat. application 71.13247 and comprising a silicon layer which is connected to an antimony trisulphide layer via a continuous hetero junction has a small sensitivity (see, for example, also FIG. 8 of the article by J. A. Hall in "Photo-electronic Image Devices", pp. 229–240 in Advances in Electronics and Electron Physica, Vol. 33A, 1972), so that the output signal of the tube is not obtained via the primary electron beam but by amplification of the electron beam reflected by the antimony trisulphide layer.

Moreover, a sulphur- or selenium-containing layer forming a hetero junction with a radiation-receiving silicon plate often has a very high resistance so that a camera tube which has such a target often is slow.

One of the objects of the invention is to avoid the above-mentioned problems at least for the greater part and to provide a camera tube which has an optimum combination of properties and which can be manufactured in a simple manner.

The invention is inter alia based on the discovery that the target of such a camera tube should in particular have a hetero junction of a good quality, cq. a good matching of the silicon layer and the chalcogen-containing layer with respect to bands, Fermi levels and crystal lattices, while avoiding annoying defects and intermediate layers in the hetero junction as much as possible.

The camera tube according to the invention is therefore characterized in that the chalcogen-containing layer comprises at least one element of the fourth main group of the periodic table of elements and the overall concentration of the said element in an atomic ratio to the chalcogen component lying between 1:1 and 1:2. The chalcogen-containing layer shows substantially intrinsic conductivity.

The sensitivity of a camera tube having such a target is comparable to that of a known silicon vidicon tube having a mosaic of diffused diodes. Recombination of charge carriers at the hetero junction between the silicon layer and the chalcogen-containing layer comprising the element of the fourth main group is small. The resolving power is large, details of approximately 10 μm can be detected by the electron beam on a normal vidicon format (12.8 × 9.6 mm) and with 25 pictures per second.

Germanium is preferably chosen as an element of the fourth main group.

In addition to germanium the chalcogen-containing layer comprises preferably 50 atom% sulphur and/or selenium. In a vitreous or substantially vitreous structure of the chalcogen-containing layer compositions optimum for the properties may be chosen. Camera tubes having targets in which the chalcogen-containing layer consists of two suitable sub-layers of which one adjoins the silicon layer and comprises germanium and the other comprises gallium may also be used as will be described hereinafter. The hetero junction between the silicon layer and the chalcogen-containing layer may be a rectifying junction. In these targets the silicon is of the n-conductivity type.

However, the invention is not restricted to targets having silicon layers of the n-conductivity type.

For example, the silicon layer may comprise a rectifying junction which is separated from the hetero junction by a high-ohmic layer of the p-type. Mutually separated low-ohmic regions of the p-type which adjoin the hetero junction may be formed in the high-ohmic layer.

The invention furthermore relates to a target suitable for use in a camera tube formed by a radiation-receiving silicon layer which on a side to be scanned by an electron beam has a chalcogen-containing layer which forms a hetero junction with the silicon layer, characterized in that the chalcogen-containing layer comprises at least one element of the fourth main group of the periodic table of elements in an atomic ratio to the chalcogen component lying between 1:1 and 1:2.

The invention also relates to a method of manufacturing a target, characterized in that after the formation of the hetero junction the silicon layer and the chalcogen-containing layer are subjected to a thermal treatment.

The temperature during the thermal treatment preferably is less than 450° C.

The invention will now be described in greater detail with reference to a number of examples and the accompanying drawing.

In the drawing

Figure 1:
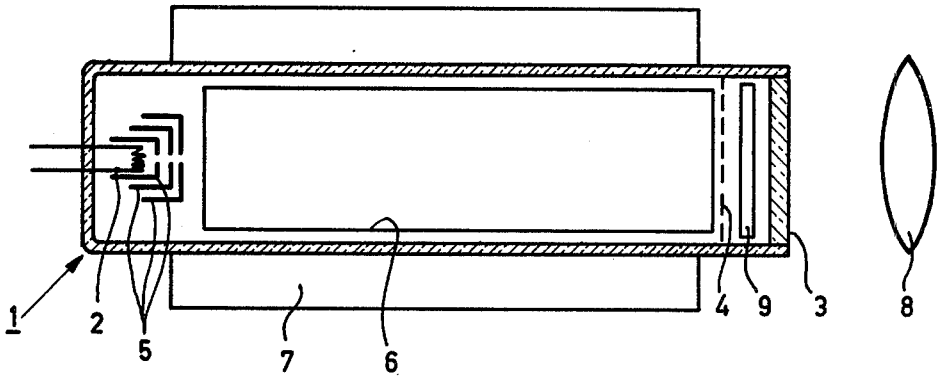
FIG. 1 shows diagrammatically a camera tube according to the invention.

The camera tube, for example a television camera tube, shown in FIG. 1 has an electron source or cathode 2 and a target 9 (see also FIG. 2) to be scanned by an electron beam 20 generated by said source. The target 9 is formed by a silicon layer 21 receiving radiation 24 which on a side to be scanned by the electron beam 20 has a chalcogen-containing layer 22 which forms a hetero junction 23 with the silicon layer 21.

According to the invention, the chalcogen-containing layer 22 comprises at least one element of the fourth main group of the periodic table of elements in an atomic ratio to the chalcogen component lying between 1:1 and 1:2.

In the usual manner the camera tube comprises electrodes 5 to accelerate electrons and to focus the electron beam. Furthermore conventional means are present to deflect the electron beam so that the target 9 can be scanned. Said means consist, for example, of a system of deflection coils 7. The electrode 6 serves to screen the wall of the tube from the electron beam. A picture to be picked up is projected on the target 9 by means of the lens 8, the wall 3 of the tube being permeable to radiation.

Furthermore, a collector grid 4 is present in the usual manner. By means of this grid which may be, for example, also an annular electrode, reflected and secondary electrons originating from the target 9, for example, may be removed.

Figure 2:
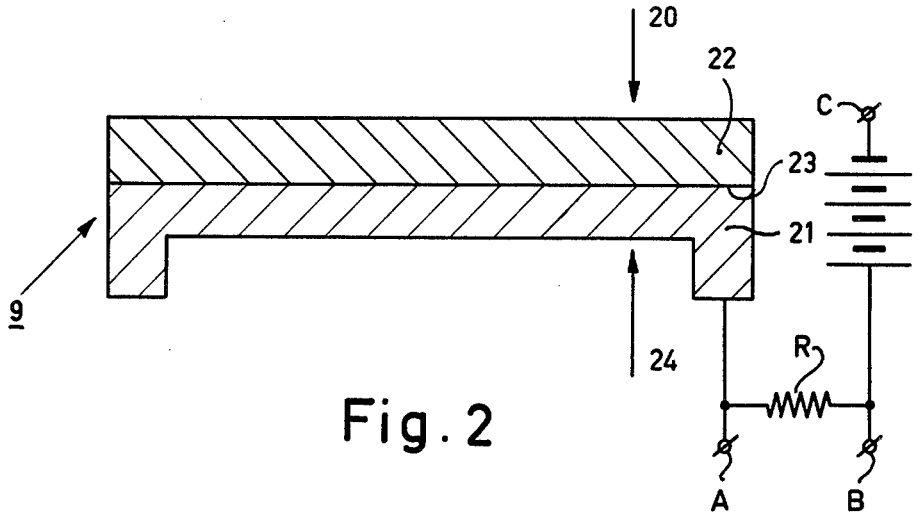
FIG. 2 shows diagrammatically an embodiment of a target for a camera tube according to the invention.

During operation the silicon layer 21 is biased positively relative to the cathode 2. In FIG. 2 the cathode is to be connected to the point C. During the scanning of the chalcogen-containing layer 22 by the electron beam 20, said layer is charged to substantially the cathode potential, the hetero junction 23 which in FIG. 2 is also a rectifying junction being reversely biased.

The layer 22 is then discharged fully or partly dependent upon the intensity of the radiation 24 which impinges upon the target. In a subsequent scanning period charge is again supplied until the layer 22 has again assumed the cathode potential. Said charge current is a measure of the intensity of the radiation 24. Output signals are derived from the terminals A and B via the resistor R.

EXAMPLE I

In the center of an n-type silicon plate having a resistivity of approximately 10 ohm.cm, a diameter of approximately 20 mm and a thickness of approximately 150 μm, a cavity having a diameter of approximately 17 mm is etched to such a depth that the thickness of the remaining silicon layer 21 is approximately 12 μm. The side of the layer 21 to be scanned by the electron beam is then cleaned as readily as possible and oxide is removed. A germanium and sulphur-containing vitreous layer 22 is then vapour-deposited on the said side in a thickness between 0.01 and 10 μm, for example 0.5 μm, on the layer 21 in a high vacuum of approximately $10^{-7}$ Torr. In this case the layer 22 is vapour-deposited by bringing a quartz vessel containing GeS at approximately 530° C and catching the formed vapour on the layer 21 which itself is maintained at a temperature of approximately 200° C. The target thus formed is then mounted in a television camera tube with the germanium-sulphide-glass layer facing the electron source. With a voltage difference of a few volts across the target the sensitivity proved to be comparable to that of a known Si vidicon having a mosaic of p-type Si regions, the lag was very low and the resolving power was excellent.

The target mentioned in this example may also be provided with a very thin layer of gallium-selenium glass on the germanium sulphide glass layer.

EXAMPLE II

An Si-layer as described in Example I is provided with a germanium selenide glass layer 12 in a thickness of 1.5 microns in a high vacuum of approximately $10^{-7}$ Torr. The layer is formed by bringing a quartz vessel which contains a mixture of GeSe and $GeSe_2$ which contains approximately 55 atom% selenium and approximately 590° C and catching the vapour thus formed on a silicon layer which itself is maintained at a temperature of approximately 300° C. The target thus formed is mounted in a television camera tube with the germanium selenide glass layer facing the electron source. With a voltage difference across the target of a few volts the sensitivity provdd of the same order of magnitude as that of a known Si vidicon having a mosaic of p-type Si regions, the gap was low and the resolving power excellent.

It will be obvious that the invention is not restricted to the examples described but that many variations are possible without departing from the scope of this invention. For example, it is not necessary for the silicon layer to be monocrystalline, it may also be polycrystalline. The thickness and the resistance of said layer and the thickness and the composition of the chalcogen-containing layer may also be different from that mentioned in the examples.

The resistance of the chalcogen-containing layer should be $10^{12}$ and $10^{15}$ ohm/□.

One is not restricted to the provision of the chalcogen-containing layer by evaporation.

In the circumstances described in the examples the composition of the vapour-deposited chalcogen-containing layer does not substantially differ from the composition of the vapour deposition source used.

A thin oxide layer of less than 30 A may be present between the silicon layer and the chalcogen-containing layer.

The chalcogen-containing layer may be covered for example, with an antimony trisulphide layer so as to reduce secondary electron emission and/or to avoid electron injection from the electron beam in the chalcogen-containing layer. In addition to germanium, silicon or tin may also be used in the chalcogen-containing layer and said layer may contain both sulphur and selenium, while the addition of tellurium is also possible.

It is not necessary for a good operation of the camera tube according to the invention that the chalcogen-containing layer has a homogeneous composition; a similar layer having a variation in composition may also give satisfactory results i.e. it may comprise two sub-layers, one of which 22*a* adjoining the silicon layer 23 is germanium and the other layer 22*b* on which the electron beam land is gallium.

What is claimed is:

1. A camera tube comprising an electron beam source, a target to be scanned by an electron beam emerging from said source, said target comprising a radiation-receiving silicon layer and a chalcogen-containing layer having substantially instrinsic conductivity which forms a hetero junction with the silicon layer on the side thereof scanned by the electron beam, said chalcogen-containing layer further comprises germanium in an atomic ratio to the chalcogen component lying between 1:1 and 1:2.

2. A camera tube as claimed in claim 1, wherein the chalcogen-containing layer comprises approximately 50 atom% of an element selected from the group consisting of sulphur and selenium.

3. A camera tube as claimed in claim 2 wherein the chalcogen-containing layer has a vitreous structure.

4. A camera tube as claimed in claim 3 wherein the chalcogen-containing layer consists of two sub-layers of which one which adjoins the silicon layer comprises germanium and the other comprises gallium.

* * * * *